US006909050B1

(12) United States Patent
Bradford

(10) Patent No.: US 6,909,050 B1
(45) Date of Patent: Jun. 21, 2005

(54) ELECTRICAL CABLE

(75) Inventor: Eric R. Bradford, Campbell, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 10/672,865

(22) Filed: Sep. 26, 2003

(51) Int. Cl.[7] ..... H01B 7/00
(52) U.S. Cl. ..... 174/110 R; 174/111; 174/113 R
(58) Field of Search ..... 174/36, 110 R, 174/115, 116, 117 R, 117 F, 117 FF, 114 S, 112

(56) References Cited

U.S. PATENT DOCUMENTS

| | | | | | |
|---|---|---|---|---|---|
| 2,528,667 | A | * | 11/1950 | Raabe | 343/866 |
| 2,585,054 | A | * | 2/1952 | Stachura | 174/36 |
| 3,663,739 | A | * | 5/1972 | Chevrier | 174/36 |
| 4,230,898 | A | * | 10/1980 | Emmel | 174/32 |
| 4,847,443 | A | * | 7/1989 | Basconi | 174/32 |
| 5,391,838 | A | * | 2/1995 | Plummer, III | 174/36 |
| 5,949,026 | A | * | 9/1999 | DeFlorio | 174/117 R |
| 6,111,202 | A | * | 8/2000 | Martin | 174/110 R |
| 6,374,126 | B1 | * | 4/2002 | MacDonald et al. | 455/569.1 |
| 6,538,205 | B2 | * | 3/2003 | Ueno | 174/117 F |

FOREIGN PATENT DOCUMENTS

| | | | | |
|---|---|---|---|---|
| FR | 2545973 A | * | 11/1984 | H01B/7/40 |
| JP | 48-63266 | * | 8/1973 | H01B/7/08 |
| JP | 05-062527 A | * | 3/1993 | H01B/7/08 |

* cited by examiner

*Primary Examiner*—William H. Mayo, III
(74) *Attorney, Agent, or Firm*—Peter Hsieh

(57) ABSTRACT

The present invention provides an electrical cable system including a first electrical cable and a second electrical cable. The first electrical cable includes a strip shaped insulation material with one or more electrical conductors disposed within the strip shaped insulation material. The second electrical cable includes a groove shaped insulation material for receiving the strip shaped insulation material and one or more electrical conductors disposed within the groove shaped insulation material. The first electrical cable and second electrical cable may be releasably joined to form a co-joined cable by mating the strip shaped insulation material with the groove shaped insulation material.

18 Claims, 4 Drawing Sheets

ELECTRICAL CABLE

TECHNICAL FIELD

The present invention relates to the general field of electrical cables. More specifically the invention relates to electrical cables which divide into more than one cable.

BACKGROUND

Y-junction electrical cables are commonly used when it is required to split an electrical cable into separate components and route one component cable to one location and route the other component cable to a different location. Managing such a cable is problematic as the independently routed cables may become entangled.

Headsets often utilize a format such that signals can be provided to both a user's right and left ear. In the prior art, headsets use a Y electrical cable that is joined together and then splits into two cables at a Y junction, with one cable diverging to a left ear speaker and one cable diverging to the right ear speaker. The other end of the cable is coupled to a connector which is utilized to transfer the stereo electrical signal.

Such headset cables present difficult cable management issues. The two cables diverging from the Y junction become tangled with each other as well as with the single co-joined cable opposite the Y junction.

One prior art cable utilizes two speakers in earbud form that are inline on a single cable. The cable does not utilize a Y-junction, but rather in use the length of cable disposed between the two earbuds is draped behind the neck or under the chin. However, location of the in-line earbuds presents additional cable management problems.

As a result, improved electrical cables for headsets are needed. In particular, electrical cables offering increased ease in cable management are needed.

SUMMARY OF THE INVENTION

The present invention provides a solution to the needs described above through an inventive electrical cable.

The present invention provides an electrical cable system including a first electrical cable and a second electrical cable. The first electrical cable includes a strip shaped insulation material with one or more electrical conductors disposed within the strip shaped insulation material. The second electrical cable includes a groove shaped insulation material for receiving the strip shaped insulation material and one or more electrical conductors disposed within the groove shaped insulation material. The first electrical cable and second electrical cable may be releasably joined to form a co-joined cable by mating the strip shaped insulation material with the groove shaped insulation material.

The present invention further provides a headset including a first speaker coupled to a first electrical cable and a second speaker coupled to a second electrical cable. The first electrical cable includes one or more electrical conductors disposed within a first insulation material. The first insulation material is shaped to form a first component of a releasable press-and-fit seal. The second electrical cable includes one or more electrical conductors disposed within a second insulation material. The second insulation material is shaped to form a second component of the releasable press-and-fit seal.

The present invention further provides a method for managing an electrical cable. The method includes providing a first electrical cable comprising a strip shaped insulation material with one or more electrical conductors disposed within the strip shaped insulation material. A second electrical cable is provided including a groove shaped insulation material for receiving the strip shaped insulation material. One or more electrical conductors are disposed within the groove shaped insulation material. The method further includes mating the strip shaped insulation material with the groove shaped insulation material to releasably join the first electrical cable and second electrical cable.

DESCRIPTION OF THE DRAWINGS

The features and advantages of the apparatus and method of the present invention will be apparent from the following description in which.

DETAILED DESCRIPTION OF THE PREFERRED EMBODIMENTS

The present invention provides a solution to the needs described above through an inventive electrical cable system.

Other embodiments of the present invention will become apparent to those skilled in the art from the following detailed description, wherein is shown and described only the embodiments of the invention by way of illustration of the best modes contemplated for carrying out the invention. As will be realized, the invention is capable of modification in various obvious aspects, all without departing from the spirit and scope of the present invention. Accordingly, the drawings and detailed description are to be regarded as illustrative in nature and not restrictive.

The present disclosure describes an electrical cable system. Although reference is made to use of the electrical cable system with a headset, the electrical cable system may also be utilized with any application where it is useful to split an electrical cable at a Y junction into separate electrical cables. The electrical cable may be used to transmit an audio signal, electrical power, or other electrical signal. The present invention allows separate electrical cables to be releasably joined together and separated when desired. In particular, the electrical cable system provides for a press-and-fit releasable seal system with each individual cable serving as a component in the releasable seal system. Furthermore, the cable system includes a slider for initiating the joining and releasing of the cables.

Figure 1:
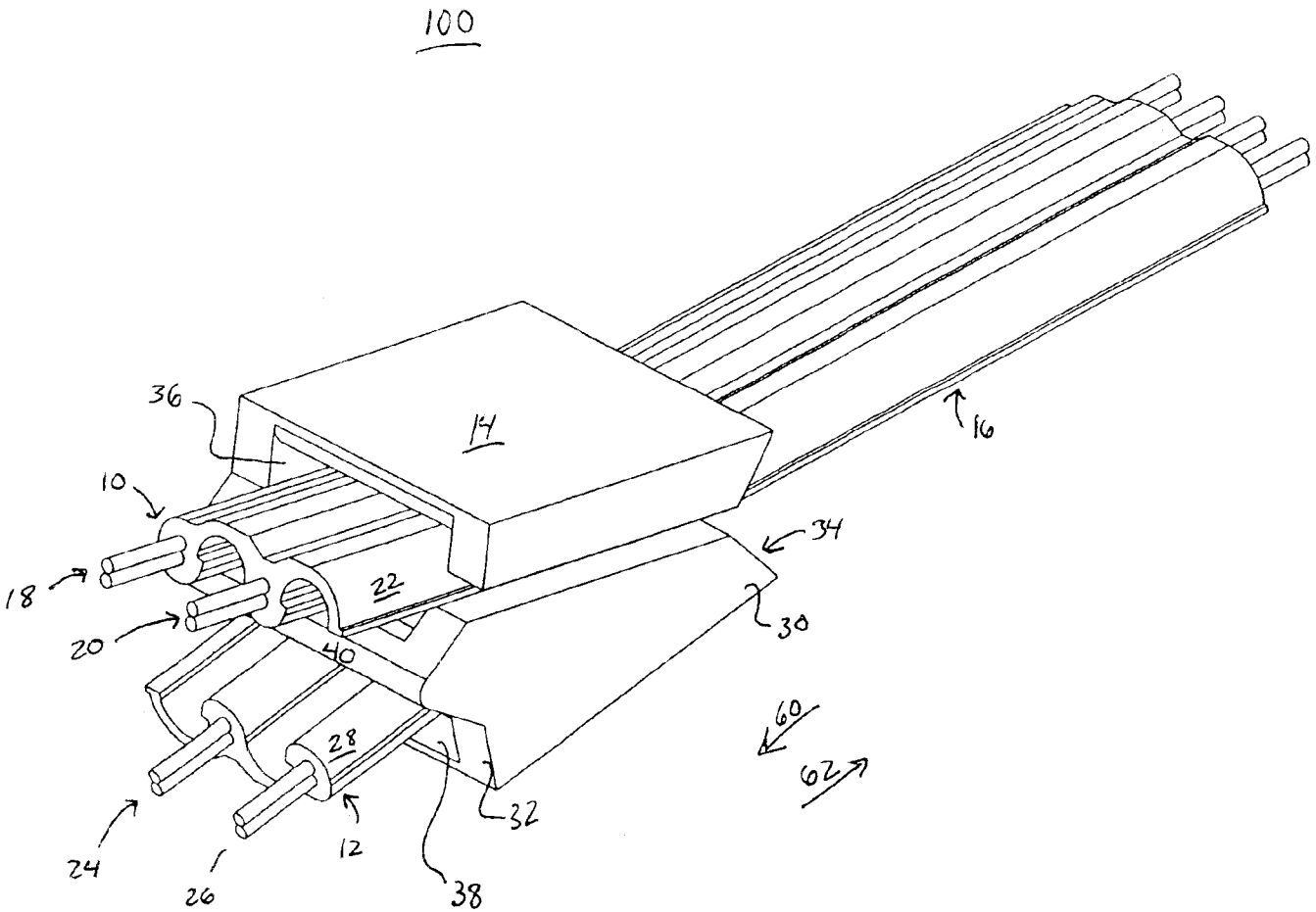
FIG. 1 is a perspective view of an embodiment of the electrical cable of the present invention illustrating the releasable sealing process.
Figure 2:
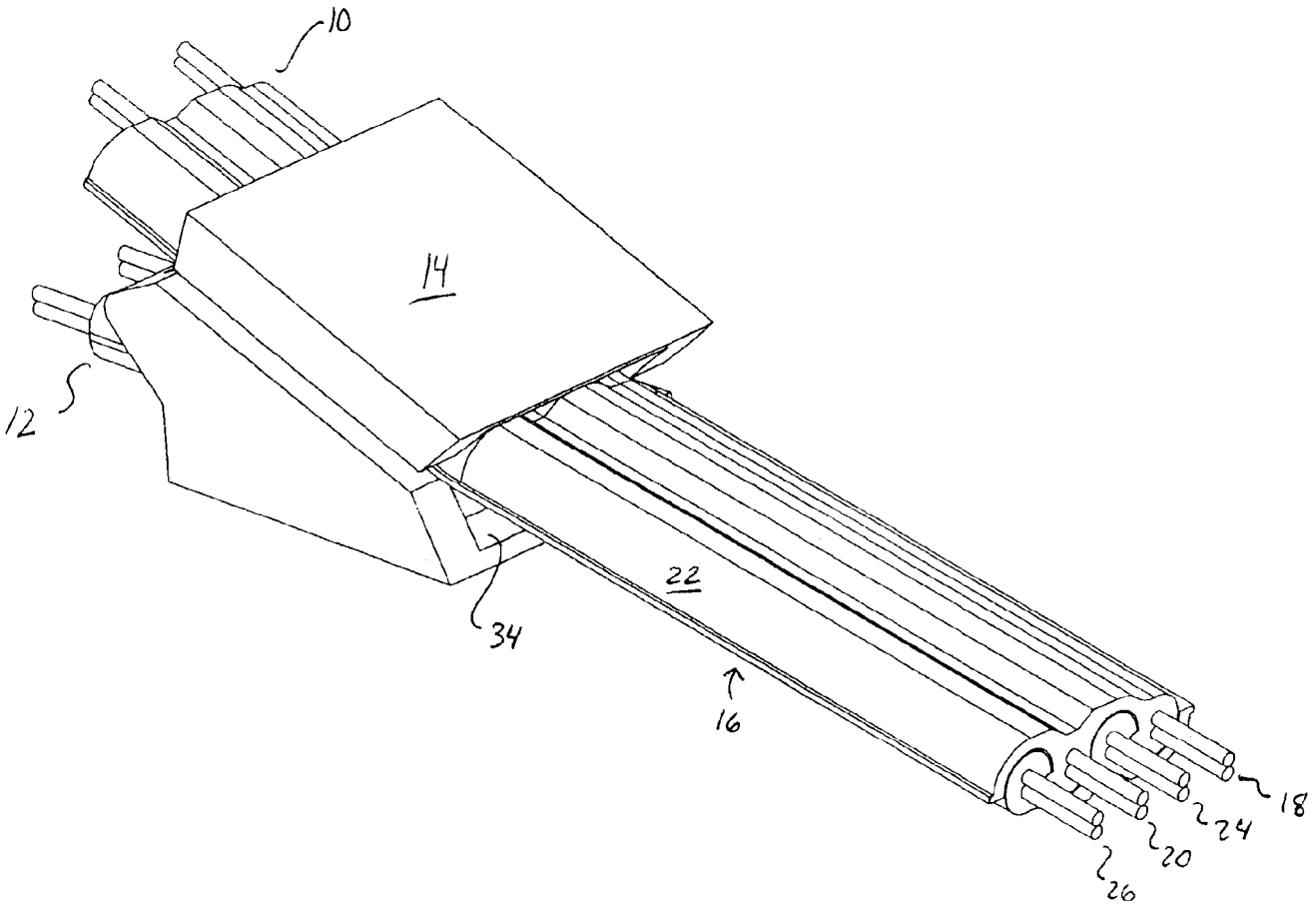
FIG. 2 is a further perspective view of an embodiment of the electrical cable of the present invention illustrating the releasable sealing process.

Referring to FIGS. 1 and 2, perspective views of an embodiment of the electrical cable of the present invention illustrating the releasable sealing process are shown.

The electrical cable system 100 (also referred to herein as "electrical cable") comprises a cable 10, cable 12, slider 14, and co-joined cable 16 formed from cable 10 and cable 12. In an exemplary embodiment of the invention, cable 10 may include one or more electrical conductors 18, 20 disposed within an insulation material 22. Cable 12 may include one or more electrical conductors 24, 26 disposed within an insulation material 28. Slider 14 is capable of bi-directional movement along the length of electrical cable 100. Slider 14 includes a seal end 30 and separator end 32.

Seal end 30 of slider 14 contains an aperture 34 through which the co-joined cable 16 passes through. Separator end 32 of slider 14 contains an aperture 36 and an aperture 38 separated by a divider 40. Cable 10 passes through aperture 36 and cable 12 passes through aperture 38. In an embodiment of the invention, slider 14 is made of plastic, but metal or other materials may be used.

Figure 3:
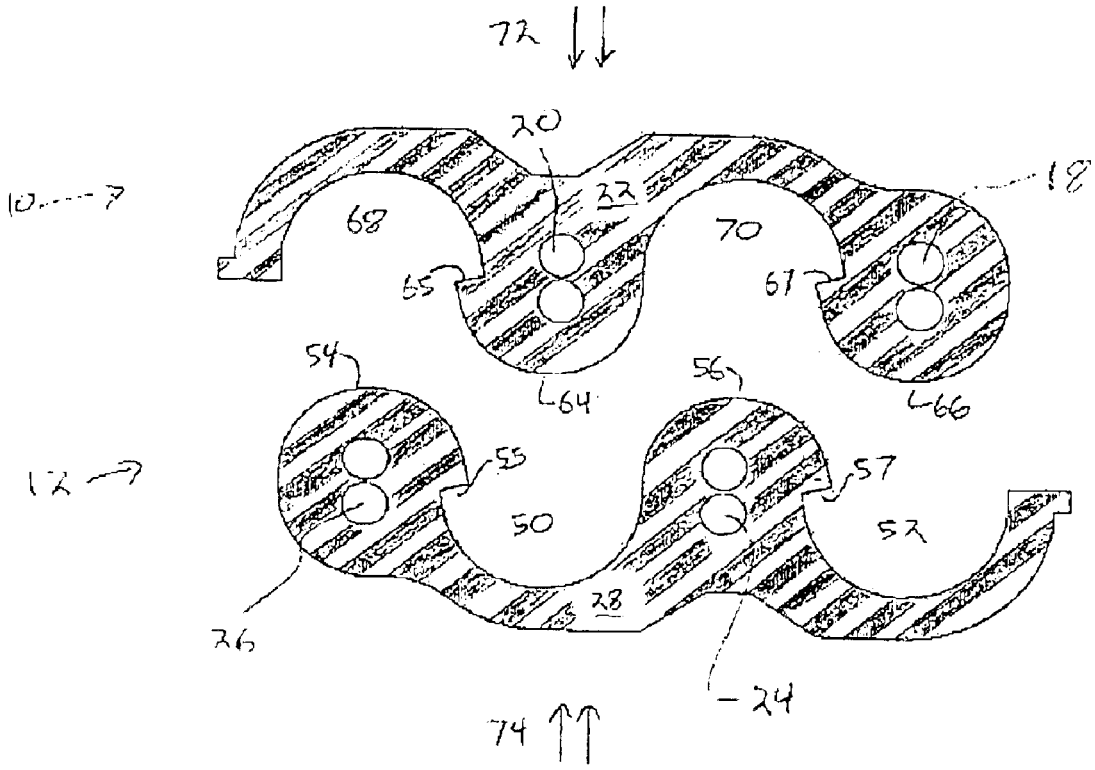
FIG. 3 is a side view of an embodiment of two cables of the electrical cable system of the present invention prior to joining.

Referring to FIG. 3, a side view of cable 12 and cable 10 is shown prior to joining. Electrical conductors 26, 24 are disposed within insulation material 28. The insulation material 28 of cable 12 is molded to form grooves 50, 52 running the length of cable 12. The insulation material is further molded to form strips 54, 56 running the length of cable 12. Strips 54, 56 may include protruding edges 55, 57 to interlock with corresponding edges 65, 67 on strips 64, 66. The insulation material 22 of cable 10 is molded to form grooves 68, 70 running the length of cable 10. The insulation material 22 is further molded to form strips 64, 66 running the length of cable 10. Insulation material is made of a typical insulation material such as polyvinyl chloride (PVC).

Cable 10 and cable 12 may be releasably joined to form co-joined cable 16 by mating the corresponding press-and-fit seal components. Groove 50 and a corresponding strip 64 of cable 10 form a press-and-fit seal when mated together. One example of such a seal is often referred to as a "ziplock" seal. Similarly, groove 52 and corresponding strip 66 of cable 10 form a press-and-fit seal when mated together. Groove 68 and a corresponding strip 54 of cable 12 form a press-and-fit seal when mated together. Similarly, groove 70 and a corresponding strip 56 of cable 12 form a press-and-fit seal when mated together.

In operation, slider 14 is capable of bi-directional movement along cable 100. Slider 14 serves as an actuator to either join or release cable 10 and 12. Referring to FIG. 1, slider 14 is moved in a seal direction 60 to extend the length of co-joined cable 16 by joining cable 10 and cable 12 with a press-and-fit seal. Slider 14 is moved in a release direction 62 to separate the co-joined cable 16 and extend the length of cable 10 and cable 12.

Figure 4:
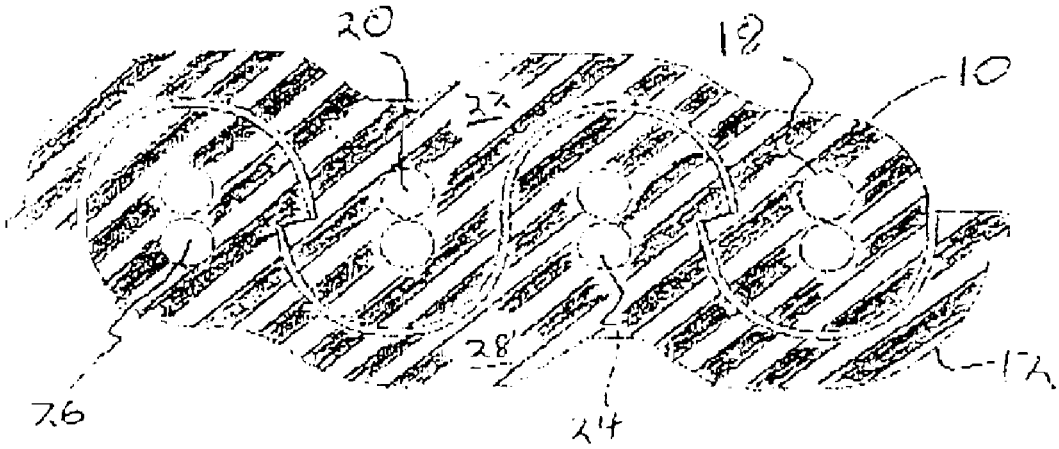
FIG. 4 illustrates a side view of an embodiment of the electrical cable illustrating two cables in a sealed state.

As slider 14 is moved in a seal direction 60, the inner surface of slider aperture 34 at seal end 30 exerts an inward force on the exterior surfaces of cable 10 and cable 12 at the intersection of aperture 34 and cable 10 and cable 12. Referring to FIG. 3, the inward force 72 and 74, presses strips 64, 66 and grooves 50, 52 together to form a press-and-fit seal. Simultaneously, strips 54, 56 and grooves 68, 70 are pressed together, forming co-joined cable 16 comprising cable 10 and cable 12. As slider 14 is moved in seal direction 60 along cable 100, the length of co-joined cable 16 is extended by joining cable 10 and cable 12 at slider end 30. Referring to FIG. 4, a side view of co-joined cable 16 is shown after slider 14 has co-joined cable 10 and cable 12.

As slider 14 is moved in a release direction 62, divider 40 of slider 14 exerts an outward force on the interior surface of cable 10 and cable 12. The outward force is transferred to co-joined cable 16, releasing the press-and-fit seal to form cable 10 and cable 12 from co-joined cable 16. Strips 64, 66 and grooves 50, 52 are separated and strips 64, 66 and grooves 50, 52 are separated at the slider 14. As slider 14 is moved in the release direction 62 along cable 100, the length of cable 10 and cable 12 is extended as the length of co-joined cable 16 is shortened.

Electrical cable 100 may be utilized to deliver signals or electrical power such as charging current. By utilizing the cable 10 and cable 12 themselves as components in a press-and-fit seal system, cable 10 and cable 12 may be joined to form co-joined cable 16 for easier cable management. Co-joined cable 16 may be easily released when it is desired to have independent routing of cable 10 and cable 12. Co-joined cable 16 may easily be stored in a conventional cable winder device. The electrical cable 100 provides a solution that offers easy and convenient use.

The invention further presents a headset that utilizes the electrical cable 100. The headset includes a left earbud speaker, right earbud speaker, electrical cable 100, and a male connector. When used as a telephone headset, the headset further includes a microphone for receiving an audio signal. Electrical conductors 18, 20 of cable 10 are coupled to the left earbud speaker. Electrical conductors 24, 26 of cable 12 are coupled to the right earbud speaker. In an embodiment of the invention, the opposite end of electrical cable 100 is coupled to a conventional joined cable that cannot be separated. A male connector is coupled to the end of the conventional joined cable for insertion into a signal source. In an embodiment of the invention, the microphone is located at the end of the conventional joined cable near the coupling with electrical cable 100.

In operation, during headset use the slider 14 is moved in the release direction 62 until the conventional joined cable is reached. As a result, cable 10 and cable 12 are of sufficient length so that left ear bud speaker and right earbud speaker may be inserted into the user's left and right ear respectively. When the headset use is completed, slider 14 is moved in a seal direction 60 to extend the length of co-joined cable 16 and minimize the length of independent cable 10 and cable 12. The co-joined cable 16 may then be easily managed for storage.

One of ordinary skill in the art will recognize that other architectures for electrical cable 100 may be employed. Furthermore, other architectures may be employed for the headset utilizing electrical cable 100. For example, the specific shape or components of slider 14 may vary. In addition, other actuators for initiating the seal or release process may be used. The shape of the strips and grooves forming the press-and-fit seal may be varied, as well as the use of any interlocking devices.

Furthermore, although two pairs of press-and-fit seals are shown, in other embodiments a cable system utilizing only one strip and one groove may be constructed. For example, the number of electrical conductors disposed within the strip and groove may vary.

Having described the invention in terms of a preferred embodiment, it will be recognized by those skilled in the art that various types of components may be substituted for the configuration described above to achieve an equivalent result. It will be apparent to those skilled in the art that modifications and variations of the describe embodiments are possible, and that other elements or methods may be used to perform equivalent functions, all of which fall within the true spirit and scope of the invention as measured by the following claims.

What is claimed is:

1. An electrical cable system comprising:

a first electrical cable comprising:

a strip shaped insulation material;

at least one electrical conductor disposed within the strip shaped insulation material;

a second electrical cable comprising:

a groove shaped insulation material for receiving the strip shape insulation material;

at least one electrical conductor disposed within the groove shaped insulation material, wherein the first electrical cable and second electrical cable may be releasably joined using a press and fit seal to form a co-joined cable by mating the strip shaped insulation material with the groove shaped insulation material such that the electrical conductor disposed within the strip shaped insulation material is at least partially inserted into the groove shaped insulation material.

2. The cable system of claim 1 further comprising an actuator, wherein the actuator comprises:

a first end defining a single aperture through which the first electrical cable and second electrical cable pass through; and a second end defining a first and second aperture separated by a divider, wherein the first electrical cable passes through the first aperture and the second electrical cable passes through the second aperture, wherein the actuator is capable of bi-directional movement along the cable system and wherein movement of the actuator in a first direction joins the first electrical cable and second electrical cable and movement of the actuator in a second direction releases the first electrical cable from the second electrical cable.

3. The cable system of claim 1, wherein the strip shaped insulation material and the groove shaped insulation material comprises polyvinyl chloride.

4. The cable system of claim 1, wherein the strip shaped insulation material further comprises a protruding edge for interlocking with the groove shaped insulation material.

5. An electrical cable system comprising:

a first electrical cable comprising:

a first strip shaped insulation material;

at least one electrical conductor disposed within the first strip shaped insulation material;

a first groove shaped insulation material; and a second electrical cable comprising:

second strip shaped insulation material for inserting into the first groove shaped insulation material;

a second groove shaped insulation material for receiving the first strip shaped insulation material; and at least one electrical conductor disposed within the second strip shaped insulation material, wherein the first electrical cable and second electrical cable may be releasably joined using a press and fit seal to form a co-joined cable by mating the first strip shaped insulation material with the second groove shaped insulation material and mating the second strip shaped insulation material with the first groove shaped insulation material such that the electrical conductor disposed within the strip shaped insulation material is at least partially inserted into the second groove shaped insulation material and the electrical conductor disposed within the second strip shaped insulation material is at least partially inserted into the first groove shaped insulation material.

6. The cable system of claim 5 further comprising an actuator, wherein the actuator comprises:

first end defining a single aperture through which the first electrical cable and second electrical cable pass through; and a second end defining a first and second aperture separated by a divider, wherein the first electrical cable passes through the first aperture and the second electrical cable passes through the second aperture, wherein the is capable of bi-directional movement along the cable system, and wherein movement of the actuator in a first direction joins the first electrical cable and second electrical cable and movement of the actuator in a second direction releases the electrical cable from the second electrical cable.

7. The cable system of claim 5, wherein the first strip shaped insulation material, second strip shaped insulation material, first groove shaped insulation material, and the second grove shaped insulation material comprise polyvinyl chloride.

8. The cable system of claim 5, wherein the first and second strip shaped insulation material further comprise a protruding edge for interlocking.

9. An electrical cable system comprising:

a first electrical cable comprising at least one electrical conductor disposed within a first insulation material;

a second electrical cable comprising at least one electrical conductor disposed within a second insulation material; and a means for releasably joining the first electrical cable with the second electrical cable to form a co-joined cable such that the electrical conductor disposed within the first insulation material is at least partially inserted into the second insulation material.

10. A method for managing an electrical cable comprising:

providing a first electrical cable comprising a strip shaped insulation material with at least one electrical conductor disposed within the strip shaped insulation material;

providing a second electrical cable comprising a groove shaped insulation material for receiving the strip shaped insulation material with at least one electrical conductor disposed within the groove shaped insulation material; and mating the strip shaped insulation material with the groove shaped insulation material such that the electrical conductor disposed within the strip shaped insulation material is at least partially inserted into the groove shaped insulation material to releasably join the first electrical cable and second electrical cable using a press and fit seal.

11. The method of claim 10, further comprising:

providing an actuator with a first end and second end, wherein the first end defines a single aperture trough which the first electrical cable and second electrical cable pass through, and the second end defines a first and second aperture separated by a divider, wherein the first electrical cable passes through the first aperture and the second electrical cable passes through the second aperture; and moving the actuator in a first direction to join the first electrical cable and second electrical cable and moving the actuator in a second direction to release the first electrical cable from the second electrical cable.

12. An electrical cable system comprising:

a first electrical cable comprising at least one electrical conductor disposed within a first insulation material;

a second electrical cable comprising at least one electrical conductor disposed within a second insulation material, the second insulation material including a groove into which the first electrical cable may be inserted;

wherein the first electrical cable and second electrical cable may be releasably joined to form a co-joined cable by inserting the first electrical cable into the groove of the second insulation material such that the electrical conductor disposed within the first insulation material is at least partially inserted into the groove of the second insulation material.

13. The cable system of claim 12 further comprising an actuator, wherein the actuator comprises:

a first end defining a single aperture through which the first electrical cable and second electrical cable pass through; and a second end defining a first and second aperture separated by a divider, wherein the first electrical cable passes through the first aperture and the second electrical cable passes through the second aperture, wherein the actuator is capable of bi-directional movement along the cable system, and wherein movement of the actuator in a first direction joins the first electrical cable and second electrical cable and movement of the actuator in a second direction releases the first electrical cable from the second electrical cable.

14. The cable system of claims 12, wherein the first insulation material and de second insulation material comprise polyvinyl chloride.

15. A headset comprising:

a first speaker coupled to a first electrical cable, the first electrical cable comprising an electrical conductor disposed within a first insulation material, wherein the first insulation material is shaped to form a first component of a releasable press and fit seal; and a second speaker coupled to a second electrical cable, the second electrical cable comprising an electrical conductor disposed within a second insulation material, wherein the second insulation material is shaped to form a second component of the releasable press and fit seal such that the electrical conductor disposed within the first insulation material is at least partially inserted into the second insulation material during the formation of the press and fit seal.

16. The headset of claim 15, further comprising a microphone for receiving a voice audio signal.

17. The headset of claim 15, wherein the first insulation material is strip shaped and the second insulation material is groove shaped, wherein first electrical cable and second electrical cable way be releasably joined by inserting the first insulation material into the second insulation material.

18. The headset of claim 17 further comprising an actuator, wherein the actuator comprises:

a first end defining a single aperture through which the first electrical cable and second electrical cable pass through;

a second end defining a first and second aperture separated by a divider, wherein the first electrical cable passes through the first aperture and the second electrical cable passes trough the second aperture, wherein the actuator is capable of bi-directional movement along the cable system, and wherein movement of the actuator in a first direction joins the first electrical cable and second electrical cable and movement of the actuator in a second direction releases the first electrical cable from the second electrical cable.

* * * * *